US010011106B2

(12) United States Patent
Gydesen

(10) Patent No.: US 10,011,106 B2
(45) Date of Patent: Jul. 3, 2018

(54) ANTI-BOUNCING PRINTING ROLLER/SLEEVE

(71) Applicant: Tresu A/S, Bjert (DK)

(72) Inventor: Erik Gydesen, Vejle (DK)

(73) Assignee: Tresu A/S, Bjert (DK)

( * ) Notice: Subject to any disclaimer, the term of this patent is extended or adjusted under 35 U.S.C. 154(b) by 0 days.

(21) Appl. No.: 14/768,065

(22) PCT Filed: Jan. 31, 2014

(86) PCT No.: PCT/DK2014/050022
§ 371 (c)(1),
(2) Date: Aug. 14, 2015

(87) PCT Pub. No.: WO2014/124649
PCT Pub. Date: Aug. 21, 2014

(65) Prior Publication Data

US 2016/0001544 A1 Jan. 7, 2016

(30) Foreign Application Priority Data

Feb. 18, 2013 (DK) ..... 2013 70087

(51) Int. Cl.
*B41F 13/187* (2006.01)
*B41F 13/18* (2006.01)
(Continued)

(52) U.S. Cl.
CPC ..... *B41F 3/54* (2013.01); *B41F 5/24* (2013.01); *B41F 7/00* (2013.01); *B41F 11/00* (2013.01);
(Continued)

(58) Field of Classification Search
CPC .... B41F 5/24; B41F 7/00; B41F 11/00; B41F 13/187; B41F 23/08; B41F 31/027; B41F 13/085
(Continued)

(56) References Cited

U.S. PATENT DOCUMENTS 3,119,330 A 1/1964 Kunetka
3,425,347 A * 2/1969 Nard ..... B41C 1/18 101/376
(Continued)

FOREIGN PATENT DOCUMENTS

CN 102026809 A 4/2011
CN 102529338 A 7/2012
(Continued)

*Primary Examiner* — Jill Culler
*Assistant Examiner* — Marissa Ferguson Samreth
(74) *Attorney, Agent, or Firm* — David S. Safran

(57) ABSTRACT

A printing roller for a printing machine, e.g., for a flexographic printing machine, wherein the printing roller includes a rotary and longitudinal axis and an external surface, the external surface being substantially cylindrical and adapted for mounting a plate. The new feature of a printing roller according to the invention is that the external cylindrical surface includes at least one longitudinal groove, where the at least one longitudinal groove includes a geometry with one or more surfaces, the surface or surfaces lying within a circumscribed cylindrical surface for the external surface of the printing roller. In other words, this means that the longitudinal groove or grooves are cutouts in the form of milled or ground grooves in the external cylindrical surface itself on a printing roller.

9 Claims, 4 Drawing Sheets

(51) Int. Cl.

| | |
|---|---|
| ***B41F 3/54*** | (2006.01) |
| ***B41F 7/00*** | (2006.01) |
| ***B41F 11/00*** | (2006.01) |
| ***B41F 31/02*** | (2006.01) |
| ***B41F 23/08*** | (2006.01) |
| ***B41F 5/24*** | (2006.01) |
| ***B41F 13/10*** | (2006.01) |
| ***B41F 27/10*** | (2006.01) |
| ***B41F 13/08*** | (2006.01) |

(52) U.S. Cl.
CPC ..... *B41F 13/085* (2013.01); *B41F 13/10* (2013.01); *B41F 13/187* (2013.01); *B41F 23/08* (2013.01); *B41F 27/105* (2013.01); *B41F 31/027* (2013.01)

(58) Field of Classification Search
USPC ..... 101/375, 378
See application file for complete search history.

(56) References Cited

U.S. PATENT DOCUMENTS

| | | | | |
|---|---|---|---|---|
| 4,895,072 | A * | 1/1990 | Rich | B41F 13/085 101/216 |
| 4,934,266 | A * | 6/1990 | Fantoni | B41F 27/105 101/375 |
| 5,673,623 | A | 10/1997 | Schmid | |
| 6,370,123 | B1 | 4/2002 | Woo | |
| 7,730,835 | B2 * | 6/2010 | Iwamoto | B41F 27/1206 101/378 |
| 2003/0037687 | A1 | 2/2003 | Aubanel | |
| 2005/0257706 | A1 | 11/2005 | Simon et al. | |
| 2008/0105198 | A1 * | 5/2008 | Walther | B41F 31/26 118/258 |
| 2009/0120314 | A1 | 5/2009 | Iwamoto | |
| 2010/0122638 | A1 | 5/2010 | Schneider et al. | |
| 2016/0159071 | A1 * | 6/2016 | Ludin | B41F 5/24 101/217 |
| 2016/0159078 | A1 * | 6/2016 | Fujiwara | B41F 27/10 101/407.1 |

FOREIGN PATENT DOCUMENTS

| | | | | |
|---|---|---|---|---|
| DE | 2 330 947 | A1 | 1/1974 | |
| DE | 84 36 119 | U1 | 1/1986 | |
| DE | 198 34 068 | C1 | 2/2000 | |
| DE | 102 32 551 | A1 | 2/2004 | |
| DE | 10 2004 013 758 | A1 | 10/2005 | |
| DE | 102005007096 | * | 8/2006 | B41F 9/06 |
| DE | 20 2011 003 377 | U1 | 6/2011 | |
| EP | 0021006 | * | 1/1981 | B41F 13/085 |
| EP | 0 858 887 | A1 | 8/1998 | |
| EP | 1 762 383 | A1 | 3/2007 | |
| EP | 1 894 720 | A1 | 3/2008 | |
| EP | 2 428 361 | A1 | 3/2012 | |
| JP | 2-150238 | U1 | 12/1990 | |
| JP | 4-2631 | U1 | 1/1992 | |
| JP | 11-20123 | A | 1/1999 | |
| JP | 2008-230194 | A | 10/2008 | |
| JP | 2009-241312 | A | 10/2009 | |
| WO | 2004/065123 | A1 | 8/2004 | |
| WO | 2004/087422 | A1 | 10/2004 | |
| WO | WO2004087422 | * | 10/2004 | B41F 23/08 |
| WO | 2005/092618 | A1 | 10/2005 | |
| WO | 2011/139215 | A1 | 11/2011 | |

* cited by examiner

ANTI-BOUNCING PRINTING ROLLER/SLEEVE

BACKGROUND OF THE INVENTION

Field of the Invention

The present invention concerns a printing roller with a sleeve for a printing machine, e.g., a flexographic printing machine, including a rotary and longitudinal axis, where the printing roller is adapted for concentric mounting of the sleeve, and where the sleeve has a substantially internal cylindrical surface for contact with the printing roller, and wherein the sleeve has an external surface, the external surface being substantially cylindrical and adapted for mounting a plate.

Description of Related Art

The invention also concerns a sleeve for a printing roller for a printing machine, e.g., a flexographic printing machine, including a rotary and longitudinal axis, where the sleeve is adapted for concentric mounting on the printing roller, and where the sleeve has a substantially internal cylindrical surface for contact with the printing roller, and wherein the sleeve has an external surface, the external surface being substantially cylindrical and adapted for mounting a plate.

The invention further concerns a printing machine, e.g., a flexographic printing machine, which includes at least a doctor blade, a screen roller, a printing roller and a counterpressure roller, wherein the printing roller is adapted for mounting a plate, and use of a printing roller with a sleeve according to the invention for a printing machine.

It is commonly known that in connection with printing units a so-called doctor blade chamber is used from which ink/glue/varnish is applied to a roller, typically an anilox roller/screen roller. Moreover, ink is transferred from the screen roller to a plate/flexographic plate which is mounted on a printing roller/plate roller. On the printing roller, the plate is mounted either directly on the printing roller or on a so-called "sleeve" or "plate sleeve". The term "sleeve" may well be translated into the Danish word "skørt" or "kappe", but skilled persons working with these printing machines and their accessories however use the English word "sleeve" and is regarded as a technical term of art in the field. In the following, the term sleeve will be used to mean the covering item placed on the outside of the printing roller and on which is mounted an actual plate/flexographic plate.

By using sleeves, they, and thereby the mounted plate, can be rapidly replaced by simply dismounting the sleeve from the printing roller itself, and subsequently another sleeve with a different plate can be mounted. A sleeve is typically made of fiber composite in tubular form which is made by a suited process and with very great accuracy.

During operation of the printing machine, the respective rollers and the screen roller are bearing on the printing roller on which is mounted a plate, alternatively a sleeve with a plate. Between the printing roller and a counterpressure roller the medium on which printing is performed is conducted. The medium is typically in web form but may be constituted by single sheets of medium as well which are advanced in succession. This printing method is commonly called flexographic printing.

As mentioned, a plate extending longitudinally of the printing roller/sleeve is mounted on a printing roller or on a sleeve and along a greater or lesser part of the periphery of it and in the circumferential direction thereof. A plate is typically mounted with double adhesive tape between the plate and the surface of the printing roller/sleeve and with single adhesive tape at the leading edge of the plate. As the plate has a certain thickness, this means that when the leading edge of the plate strikes the screen roller, a jolt occurs, and when the screen roller encounters the trailing edge of the plate, a jolt occurs as well. The same kind of jolts are produced when the leading and trailing edges, respectively, encounter or leave the counterpressure roller. Since the printing roller and the other rollers are rotating at high speed, these jolts may more correctly be called vibrations that are transmitted throughout the printing machine, applying a high load on the printing machine, but also constituting a noise problem and thereby a challenge to the work environment. These jolts or vibrations are known by the term "bouncing" which is not desirable, but the problem has not hitherto been solved in connection with the use of sleeves on printing rollers.

Bouncing is a known problem with all flexographic printing machines, and entails, among others, the problem that when the plate strikes the leading edge of the screen roller, it bounces. This means that the printing roller and/or the screen roller are/is impacted by the jolt and experience(s) so large deflections that the rollers no longer are in contact with each other for some time/distance. This means that ink, glue or varnish is not transferred to the plate over a short length, typically 10 mm, or that an insufficient amount of ink, glue or varnish is transferred. The, e.g., the screen roller swings back and strikes the plate again, and then swinging once more with lack of transfer once again. Normally, bouncing occurs at least once and up to three times before the rollers do not have deflections of unfavorable magnitude. The same situation appears when the plate strikes the medium and the counterpressure roller. As mentioned, the result shows as a lack of ink, glue or varnish on the medium a short distance into the medium. The problem is particularly pronounced at the middle of respective rollers since it is here the rollers are vibrating the most. At the same time, these vibrations coming from bouncing will cause the rollers to hit their natural frequency more easily, further increasing the problem. An immediate solution to the problem with natural frequencies, and for that matter also of the problem with bouncing, can be changing the speed of the machine in order to apply ink, glue or varnish across the entire area of the medium.

Bouncing is of course entirely unwanted as it means depreciated quality or in the worst case that part of the products have to be discarded. At the same time, a reduced speed on the printing machine is unwanted as well since it reduces the capacity. An increased speed on the rollers may also be undesirable as by increased speed there may arise other challenges with regard to achieving the desired quality.

The problem of bouncing or vibrations produced by the jolts is particularly expressed when the application of varnish on the medium is involved, since a plate with a straight leading edge is frequently used here. However, the problem is very much present when applying glue and ink as well. That the plate has a straight leading edge striking the screen roller at once across the entire width of the plate, in this way actuating the screen roller away from the printing roller, means that bouncing is produced. Similarly, the straight trailing edge of the plate encounters the screen roller at once, whereby actuation caused by the thickness of the plate in direction away from the printing roller disappearing, also causing bouncing though in a lesser degree. Furthermore, the same occurs, in principle as also mentioned above, when the plate strikes and leaves the counterpressure roller. Here, however, there is not the same strong effect as by the screen roller which is due to the fact that the medium on which printing is performed in some cases act as a kind of shock absorber. In the cases where the medium is thin paper there is, however, very much the same problem with bouncing as between printing roller and screen roller. Thus, there are contributions from the screen roller as well as from the counterpressure roller contributing to the general effect called bouncing.

As mentioned, these circumstances are particularly problematic when the leading and/or trailing edge of the plate are/is straight and parallel with the rotary axis of the printing roller. When using a plate where the leading and/or trailing edge have/has a shape which is not parallel with the rotary axis of the printing roller, the problem is smaller, but still very present as the plate is mounted externally of the sleeve and thereby causes a thickening of the sleeve.

Even if a plate, in some cases, has a very small thickness of, e.g., a few tenths of a millimeter, the leading edge of the plate encounters the screen roller and leaves it again, irrespectively of its shape. A plate or flexographic plate can also be with a thickness of, e.g., one or more millimeters. This, in some cases modest, thickness and the fact that a certain contact pressure is to be maintained between plate/printing roller and the screen roller in order to ensure optimal application of ink, glue or varnish means that the jolts—bouncing—will arise.

In many cases are used printing rollers/sleeves with a circumference which is greater than the extension of a plate, and even several independent plates can be arranged on a printing roller/sleeve. In other words, this means by a rotation of a printing roller, one or more plate leading edges and one or more plate trailing edges will be present, all contributing to the unwanted bouncing vibrations.

None of the prior art methods for mounting plates on printing rollers or on sleeves for flexographic printing machines where the plate does not go all the way around the printing roller/sleeve are optimal, and they all have the drawback that they entail bouncing as mentioned above. There is therefore an acknowledged problem, but no solution to this problem.

SUMMARY OF THE INVENTION

It is thus the object of the invention to indicate a printing roller with a sleeve which is particularly suited for use in flexographic printing machines by which the above described problem of bouncing is removed or appreciably reduced, and where mounting of a plate on a printing roller with a sleeve is made easier and faster. It is also an object of the invention to indicate a sleeve for a printing roller for a printing machine and which is particularly suited for use in flexographic printing machines, also for solving the above mentioned problem of bouncing. At the same time, it is the object of the invention to indicate a printing machine with a printing roller with a sleeve and use of such.

As mentioned in the introduction, the invention concerns a printing roller with sleeve for a printing machine, e.g., a flexographic printing machine, including a rotary and longitudinal axis, where the printing roller is adapted for concentric mounting of the sleeve, and where the sleeve has a substantially internal cylindrical surface for contact with the printing roller.

The new feature of a printing roller according to the invention is that the sleeve has an external surface wherein the external surface is substantially cylindrical and adapted for mounted of a plate, and where the external and substantially cylindrical surface includes at least one longitudinal groove, where the at least one longitudinal groove includes a geometry with one or more surfaces, the surface or surfaces lying within a circumscribed cylindrical surface for the external surface of the printing roller.

By using a sleeve, there is achieved possibility of performing a rapid change of sleeve with plate to another sleeve with a different plate. It is ensured hereby that the printing machine can resume operation quickly as setting up to a different task will not take appreciable time compared with the case where a plate is to be dismounted and a new one mounted directly on the printing roller.

In other words, this means that the longitudinal groove or grooves are milled or ground grooves in the external cylindrical surface itself on the sleeve of a printing roller. Such a printing roller can be made wholly or partly of, e.g., steel, other suitable metal or metal alloy, of fiber composite or other suitable synthetic material, whereas the sleeve can advantageously be made of fiber composite, but other suitable materials can be used as well.

Such a groove may advantageously be used for mounting the leading edge of the plate such that the leading edge and the outermost surface of the plate is lowered a bit into the surface of the sleeve. Hereby is achieved the great advantage that the screen roller so to say is guided into contact with the plate, thereby minimizing the jolt that otherwise would occur by contact between plate and screen roller. It can be said that the screen roller in principle is running on a ramp constituted by the plate which over a given length is lowered relative to the surface of the sleeve. The jolt that causes bouncing is absolutely desirably to be minimized or avoided completely, which is possible with a printing roller with a sleeve according to the invention where the leading edge of the plate is mounted in a longitudinal groove that is countersunk in relation to the remaining surface of the sleeve. At the same time, it is faster and easier to mount a plate as the work of placing the leading edge on the sleeve does not require quite the same amount of attention as the leading edge is not subjected to the same great load again and again.

In a variant of a printing roller with sleeve for a printing machine according to the invention, the sleeve includes at least one longitudinal groove in the substantially cylindrical external face, where the longitudinal groove or grooves include a plane surface. It is thus the case that in principle the sleeve has been removed of part of the external cylindrical surface by milling, grinding or in other ways such that a plane area then is appearing, extending in longitudinal direction of the sleeve in all of the area in which the leading edge of a plate is to be mounted. The longitudinal groove can extend across part of the length of the sleeve, but in a preferred embodiment such a longitudinal groove extends in the entire length of the sleeve. For the sake of good order it is to be mentioned that such a longitudinal groove can be produced in various ways. As mentioned, it can be machining, e.g., milling or grinding, but the longitudinal groove or grooves can also be formed entirely or partially during moulding of, e.g., a sleeve in a fiber composite material.

A printing roller with a sleeve for a printing machine according to the invention may, in another variant, include at least one longitudinal groove in the substantially cylindrical external face, where the longitudinal groove or grooves include a concave surface. Such a concave surface can typically be made with a radius which is greater than radius on the external surface of the sleeve itself, thereby appearing as a "flatter" area than the external surface. However, there may also be provided a concave shape which is not immediately defined by a single radius.

In the same way, a printing roller with sleeve for a printing machine according to the invention may include at least one longitudinal groove in the substantially cylindrical external face, where the longitudinal groove or grooves include a convex surface. Such a convex surface can typically be made with a given radius but it may also be a convex shape which is not immediately defined by a single radius.

A longitudinal groove on the external surface of a sleeve may advantageously be composed of, e.g., two, three or more different plane surfaces, each with a set of dimensions. A longitudinal groove may in the same way be built up and composed of plane as well as concave and/or convex surfaces that together form a longitudinal groove which is suited and adapted for mounting a plate leading edge. The choice of geometric shape for such a longitudinal groove can be decided on the background of particular circumstances. In that connection, production cost and yield by the chosen geometry for the longitudinal groove may be considered for the specific case. By some types of printing rollers, sleeves, plates, medium, screen rollers and counterpressure rollers, there may be circumstances with greater or lesser influence on the shape of the longitudinal groove.

A printing roller with sleeve for a printing machine according to the invention may include that the at least one longitudinal groove in the substantially cylindrical external surface on the sleeve is linear and thereby parallel with the rotary axis of the printing roller/sleeve. This variant is particularly suited for use for plates for applying varnish, but may as well be used for other tasks without problems.

In an embodiment of a printing roller with a sleeve for a printing machine according to the invention, the longitudinal groove or grooves can be made with a width between 1 and 30 mm, between 2 and 20 mm or between 3 and 10 mm, where the width of the groove is measured on a cross section of the sleeve which is at right angles to the rotary axis of the printing roller/sleeve. The width of the groove may in principle be made with any dimension, but there is an expressed wish that the plate and the screen roller are in full contact with the desired surface pressure practically instantly, and at the latest within a few millimeters and highly desirable within, e.g., 5 mm or even less.

A printing roller with a sleeve for a printing machine according to the invention can be designed such that the longitudinal groove or grooves have a depth between 0 and 3 mm, between 0.1 and 2 mm or between 0.2 and 1.5 mm, where the depth is the distance between the circumscribed cylindrical surface of the sleeve and the bottom of the groove as measured on a cross-section at right angles to the rotary axis of the printing roller/sleeve.

In a preferred embodiment of a longitudinal groove, the depth thereof is typically between 0.05 and 0.1 mm, largely corresponding to the plate being at level with the screen roller when the two units meet and come into mutual contact.

A longitudinal groove according to the invention will typically be a groove which has a depth of 0 mm at the periphery on the external surface, meaning that the groove, in principle, does not have a depth at the beginning where the surface of the sleeve is broken, but is continuously building up the depth, so to say, due to the geometry of the groove. Hereby, the best contact is achieved between the plate on the surface of the sleeve and the leading edge of the plate which is mounted in the longitudinal groove. The longitudinal groove may at the same time have another edge which is actually offset in relation to the external surface of the sleeve, where this edge can be used for abutting on the leading edge of the plate during mounting of the plate in order thereby to achieve an easier and more accurate mounting of a plate.

There may, e.g., be a longitudinal groove starting at the surface of the sleeve and ending with a depth between 0.05 and 0.2 mm, and where between plate and screen roller there is a "press" of 0.1 mm corresponding to a distance that is 0.1 mm less than the thickness of the plate present between sleeve and screen roller. In the case where the longitudinal groove has a depth of 0.05 mm, half of the mentioned "press" of 0.1 mm will be offset by the groove. If the longitudinal groove has a depth of 0.2 mm, the entire "press" of 0.1 mm would be offset by the groove and the pressure between screen roller and plate will be built up during rotation of the two rollers.

However, it is possible to have a longitudinal groove with a depth right from the edge of the groove in that, in one variant of the longitudinal groove, can be made as a groove for a key or with other suitable shape allowing the leading edge of the plate to be mounted in the groove. Such a solution is, however, not optimal as hereby there is not achieved the same guided movement between the plate, on the one hand, and the screen roller and counterpressure roller, respectively, on the other hand, as when there is a gradual transition between respective parts.

The geometry of the longitudinal groove can, as indicated above, be made in various ways. The choice of geometry can be freely selected according to the type and/or thickness of the wanted plate. One may thus select an actual sleeve for an actual type of plate where both parts are selected for a specific task and thus optimized for being used together. However, it is possible to have a kind of universal sleeve with one or more longitudinal grooves according to the invention which is/are used for all, or almost all, types and thicknesses of plates.

The present invention also concerns a sleeve for a printing roller for a printing machine, e.g., a flexographic printing machine, including a rotary and longitudinal axis, where the sleeve is adapted for concentric mounting on the printing roller, and where the sleeve has a substantially internal cylindrical surface for contact with the printing roller, and wherein the sleeve has an external surface, the external surface being substantially cylindrical and adapted for mounting a plate. By using a sleeve, there is achieved the possibility of performing a rapid change on a printing machine from a sleeve with a first plate to another sleeve with a different plate. It is ensured hereby that the printing machine can quickly resume operation as setting up to another task will not take much time compared with the case where a plate is to be dismounted and a new one mounted directly on the printing roller.

The invention further includes a printing machine, e.g., a flexographic printing machine which includes at least a doctor blade, a screen roller, a printing roller and a counterpressure roller, wherein the printing roller includes a concentrically mounted sleeve, the sleeve including one or more longitudinal grooves and adapted for mounting a plate, and where the printing roller is a printing roller as described above.

Finally, the invention also concerns use of such a printing roller with a concentrically mounted sleeve with longitudinal groove on a flexographic printing machine.

By the invention disclosed above, there is indicated a solution to the known problems with bouncing in that a plate can be brought into contact with either a screen roller or a counterpressure roller via the medium without bouncing arising to the hitherto known degree; in fact, bouncing can be practically eliminated by the invention. This is primarily due to the fact that the contact between respective parts occurs over a kind of gradient as the leading edge of the plate is arranged at a countersunk level relative to the substantially cylindrical surface shape of the sleeve.

The invention can also include that at the trailing edge of a plate there may also be arranged a longitudinal groove according to the same principle as that by the leading edge of the plate. The less distinct bouncing stemming from the plate leaving its engagement with the screen roller or the counterpressure roller will hereby be minimized as well, which in some case also will be attractive.

The invention is described in the following with reference to the drawings,

DETAILED DESCRIPTION OF THE INVENTION

In the explanation of the figures, identical or corresponding elements will be provided with the same designations in different figures. Therefore, an explanation of all details will not necessarily be given in connection with each single figure/embodiment as well as all elements are not necessarily provided with designations in all figures.

Figure 1:
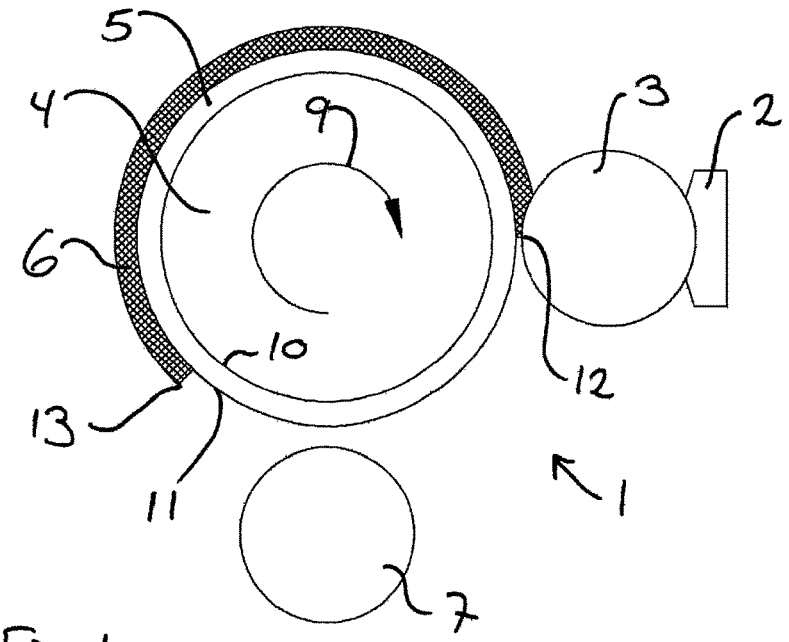
Fig. 1 (Prior Art)
FIG. 1 shows a printing machine in a first situation according to prior art.

In FIG. 1 appears a printing machine 1 according to the prior art, represented here in simple form, and wherein a doctor blade 2 appears in contact with a screen roller/anilox roller 3, to which ink, glue or varnish is transferred from the doctor blade 2. At the center appears a printing roller 4 which in the shown variant is surrounded by a sleeve 5 on which is mounted a plate 6. By rotation of the screen roller 3 and the plate roller 4 with sleeve 5 and plate 6 there is transferred ink, glue or varnish, at first from the screen roller 3 to the plate 6, and then to a medium 8 (shown only in FIG. 9). A counterpressure roller 7 appears at a position under the printing roller 4. The medium 8 is moved between this counterpressure roller 7 and the plate 6 whereby ink, glue or varnish is applied from the plate 6. The rollers 3, 4, 7, doctor blade 2, sleeve 5 and plate 6 all extend in the same direction, and FIG. 1 only shows a cross-sectional view of these units. The direction of rotation of the printing roller is shown by arrow 9 encircling the axis of rotation which is extending "into the drawing" and in the longitudinal direction at the radial center of the printing roller. The sleeve 5 has an internal cylindrical surface 10 and an external cylindrical surface 11. The plate 6 has a plate leading edge 12 and a plate trailing edge 13 that delimit the plate in its extension on the periphery of the sleeve 5.

In the shown situation, the plate leading edge 12 is in contact with the screen roller 3, which is exaggerated here in order to clarify the problem. Since the distance between the screen roller 3 and the external surface 11 of the sleeve 5 is less than the thickness of the plate 6, this will cause a jolting, called bouncing, for each rotation performed by the printing roller 4. Actually, bouncing will also occur when the plate trailing edge 13 passes the screen roller 3. Furthermore, bouncing will also occur when the plate leading edge 12 and the plate trailing edge 13 encounter and leave, respectively, the counterpressure roller. This bouncing causes an unwanted physical load on the printing machine 1 itself, but also some noise and thereby a challenge to the work environment.

Figure 2:
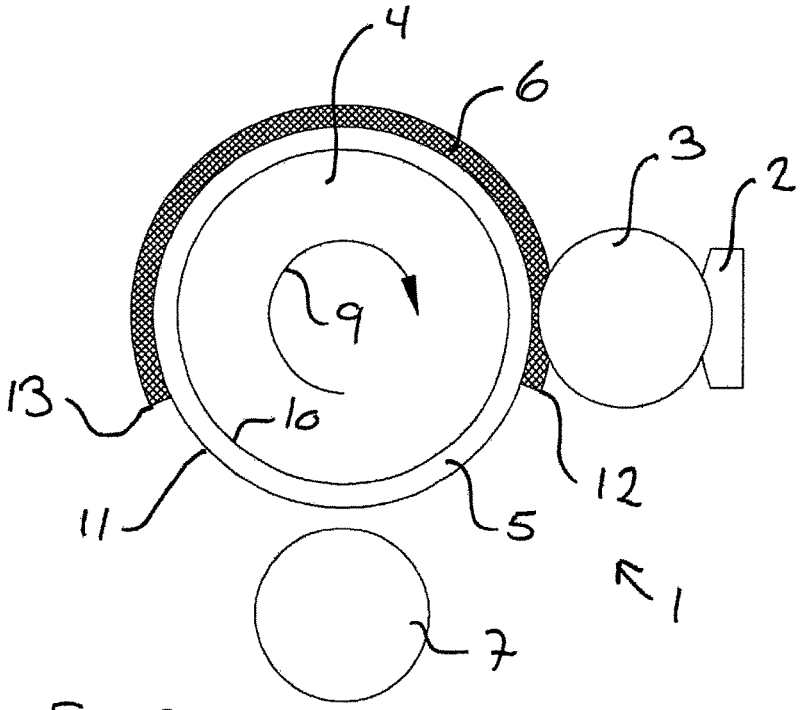
Fig. 2 (Prior Art)
FIG. 2 shows a printing machine in a second situation according to prior art.

In FIG. 2, appears the same printing machine as in FIG. 1, but here with the screen roller 3 in full contact against the plate 6 on the sleeve 5 on the printing roller 4. Here again, the drawing is exaggerated in order to illustrate that the screen roller 3 and the printing roller 4 are arranged such that a certain contact pressure is built up between these parts.

Figure 3:
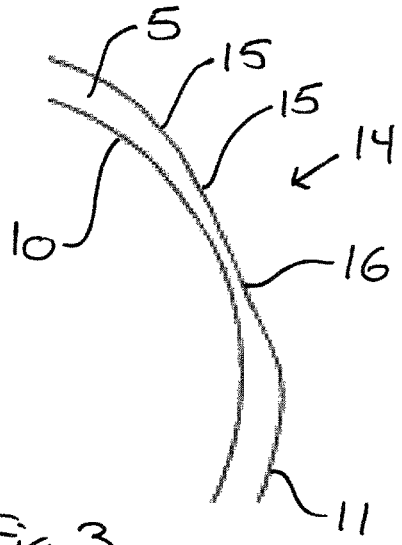
FIG. 3 shows a detail of a sleeve with a first example of a longitudinal groove.

FIG. 3 shows a detail of a sleeve 5 where, in this external cylindrical surface 11, there is provided a longitudinal groove 14 which, in this variation, includes two convex areas 15 and one concave area 16. These areas 15, 16 together form a longitudinal groove 14 in which the leading edge of a plate 6 can be fixed. In this regard, while in the conventional sense only the concave area 16 can be considered a groove, from the standpoint of this disclosure, the term "longitudinal groove" is intended to cover any shaped surface that departs from the cylindrical contour of the outer surface of the sleeve 5, whether it be planar, convex or concave.

Figure 4:
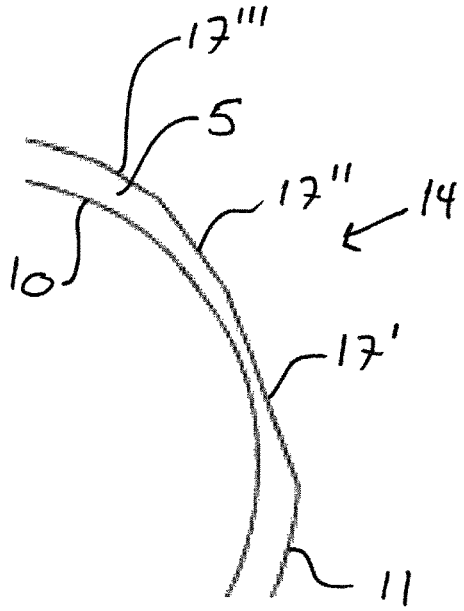
FIG. 4 shows a detail of a sleeve with a second example of a longitudinal groove.

FIG. 4 also shows a detail of a sleeve 5 where in the external cylindrical surface 11 there is provided a longitudinal groove 14 as well, which in this variation includes three planar areas 17. These planar areas 17 together form a longitudinal groove 14 in which the leading edge of a plate 6 can be fixed.

Figure 5:
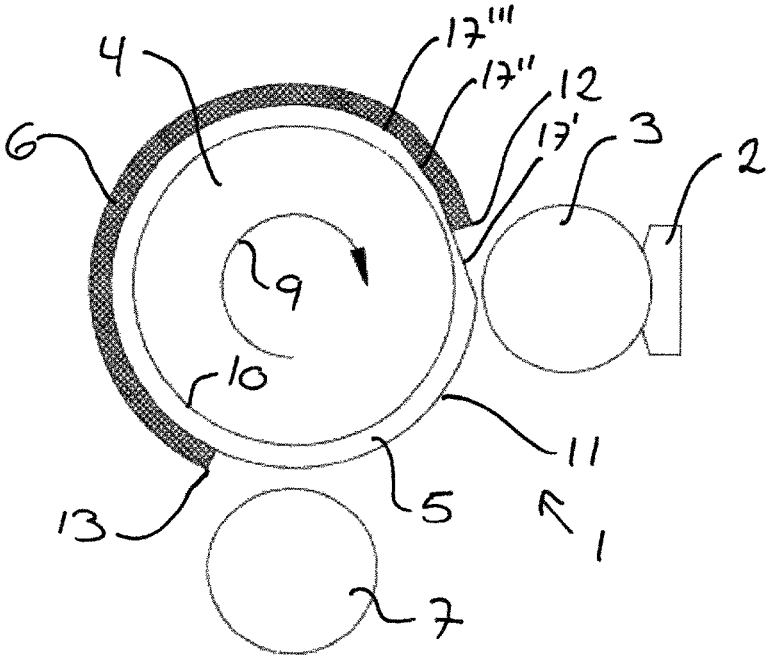
FIG. 5 shows a printing machine in a first situation.

In FIG. 5, appears a printing machine 1 according to the invention in a first position where the plate leading edge 12 is arranged on a planar area 17', extending across the other two planar areas 17" and 17'''. The shown situation is immediately before the plate leading edge 12 will encounter the screen roller 3.

Figure 6:
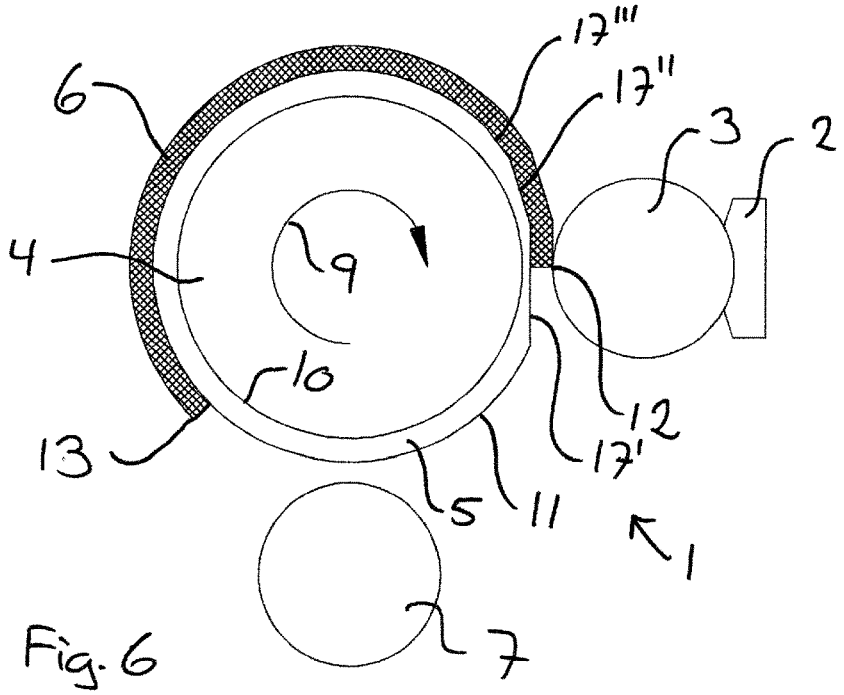
FIG. 6 shows a printing machine in a second situation.

FIG. 6 shows a situation which is immediately after the situation in FIG. 5 as the printing roller 4 has now rotated so much that the plate leading edge 12 is only barely in contact with the screen roller 3. Here, it is mentioned that, due to the longitudinal groove 14, the plate 6 is guided in under the screen roller 3 without striking the plate front edge 12 and inducing bouncing.

Figure 7:
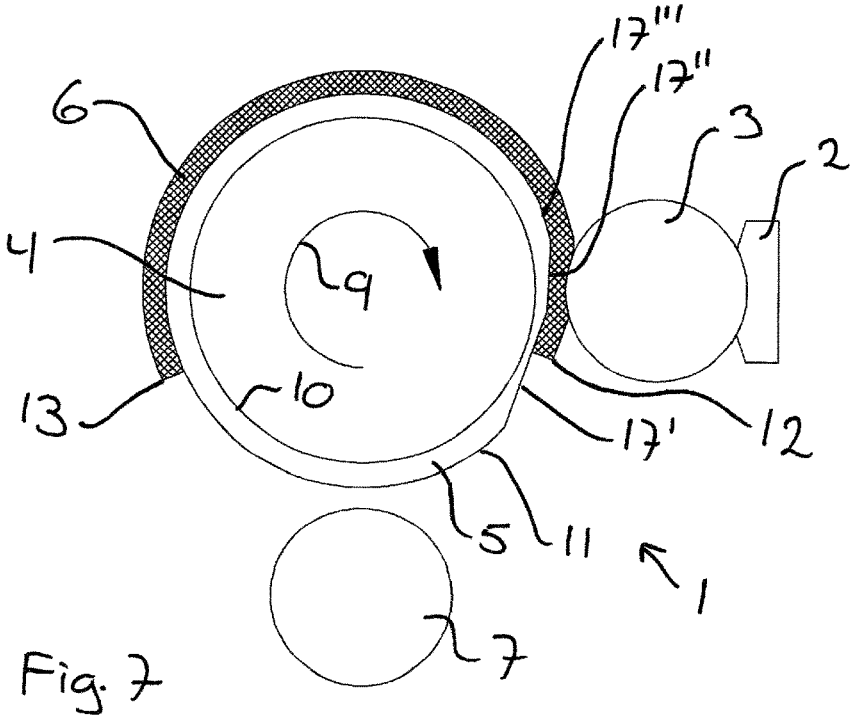
FIG. 7 shows a printing machine in a third situation.

FIG. 7 shows yet a situation where the plate 6 and the screen roller 3 are on their way to full contact pressure. In this Figure, the screen roller 3 is, however, only on its way up along the second planar area 17", and only after passing the third planar area 17" is there full contact pressure between the screen roller 3 and the plate 6.

Figure 8:
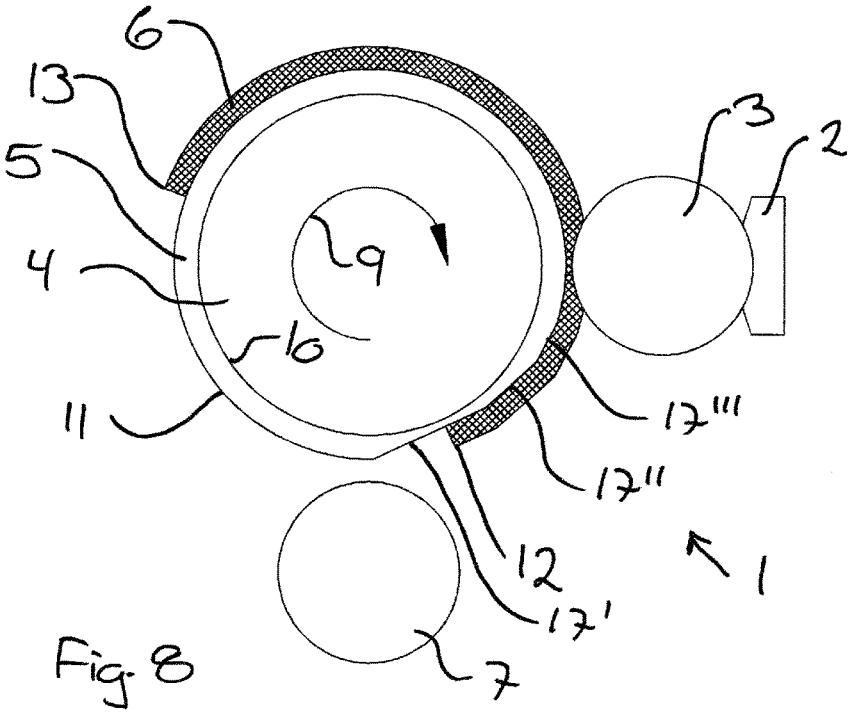
FIG. 8 shows a printing machine in a fourth situation.

In FIG. 8, the screen roller 3 is shown in full contact pressure against the plate 6 as the printing roller 4 is now rotated so much that the longitudinal groove 14 has passed the line of contact between screen roller 3 and plate 6. In FIG. 8, furthermore, it can be seen that the plate leading edge 12 approaches the counterpressure roller 7 where the same advantage as by the longitudinal groove 14 is achieved.

Figure 9:
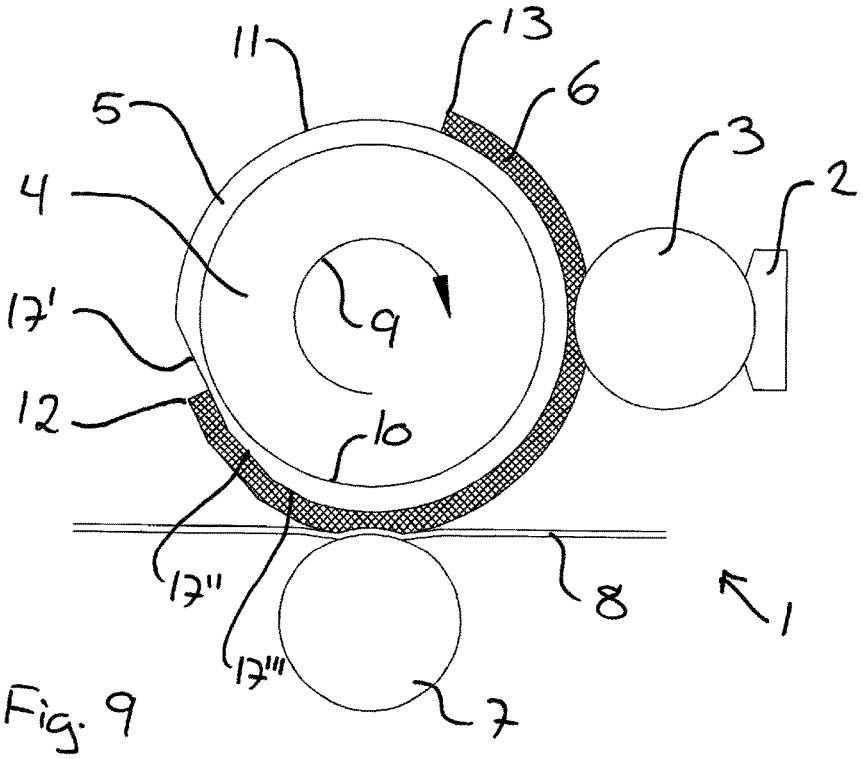
FIG. 9 shows a printing machine in a fifth situation.

Finally, it is seen in FIG. 9 that the plate 6 is in contact with the screen roller 3 and the medium 8 which is transported between the counterpressure roller 7 and the plate 6. Also between the counterpressure roller 7 and the plate 6 there is a given contact pressure which is also illustrated here by an exaggerated deformation of the plate 6.

What is claimed is:

1. A printing roller with a sleeve for a flexographic printing machine, including an axis of rotation and a longitudinal axis, where the printing roller is adapted for concentric mounting of the sleeve, and where the sleeve has a substantially internal circular cylindrical surface for unbroken circumferential contact with the entire periphery of the printing roller, and wherein the sleeve has a continuous unbroken external surface, the external surface being substantially cylindrical and adapted for mounting a plate, where the external and substantially cylindrical surface includes at least one longitudinal groove, where the at least one longitudinal groove includes a geometry with one or more surfaces and in which a leading edge of the plate can be fixed, said surfaces lying within a circumscribed cylindrical area of the external surface of the sleeve, wherein the at least one longitudinal groove has a surface geometry of reduced diameter relative to and extending circumferentially continuously between the external surface of circular circumferential curvature, wherein the at least one longitudinal groove has a depth between 0 and 3 mm, wherein the depth is a distance between the circumscribed cylindrical surface of the sleeve and a bottom surface of the longitudinal groove as measured on a cross-section at right angles to the rotary axis of the printing roller/sleeve, the longitudinal groove being of a depth in a radial direction that is less than the thickness of the plate but sufficient to minimize jolting or bouncing of a leading edge upon contact with a counter-pressure roller.

2. A printing roller with sleeve for a printing machine according to claim 1, wherein the at least one longitudinal groove includes a planar surface.

3. A printing roller with sleeve for a printing machine according to claim 1, wherein the at least one longitudinal groove includes a convex surface.

4. A printing roller with sleeve for a printing machine according to claim 1, wherein the at least one longitudinal groove includes a concave surface.

5. A printing roller with sleeve for a printing machine according to claim 1, wherein the at least one longitudinal groove is linear and parallel with an axis of rotation of the printing roller.

6. A printing roller with sleeve for a printing machine according to claim 1, wherein the at least one longitudinal groove has a width in one of the following intervals: between 1 and 30 mm, between 2 and 20 mm, between 3 and 10 mm, where the width of the at least one groove is measured on a cross-section of the sleeve which is at right angles to the axis of rotation of the printing roller/sleeve.

7. A printing roller with sleeve for a printing machine according to claim 1, wherein the at least one longitudinal groove has a depth between 0.1 and 2 mm.

8. A sleeve for a printing roller for a flexographic printing machine, including an axis of rotation and a longitudinal axis, wherein the sleeve is adapted for concentric mounting on the printing roller, and wherein the sleeve has a substantially internal cylindrical surface for unbroken circumferential contact with the entire periphery of the printing roller, and wherein the sleeve has an external surface, wherein the external surface is substantially cylindrical and adapted for mounting a plate and includes at least one longitudinal groove, wherein the at least one longitudinal groove includes a geometry with one or more surfaces, wherein said surfaces lie within a circumscribed cylindrical area for the external surface of the sleeve, wherein the longitudinal groove is provided is adapted to fix a leading edge of the plate, wherein the longitudinal groove or grooves of different surface geometry being of reduced diameter relative to and extending circumferentially continuously between the external surface of circular circumferential curvature, where the longitudinal groove or grooves have a depth in one of the following intervals: between 0 and 3 mm, between 0.1 and 2 mm and between 0.2 and 1.5 mm, where the depth is a distance between the circumscribed cylindrical surface of the sleeve and the bottom of the longitudinal groove as measured on a cross-section at right angles to the rotary axis of the printing roller/sleeve, the groove being of a depth in a radial direction that is less than a thickness of the plate, but sufficient to minimize jolting or bouncing of a leading edge upon contact with a counter-pressure roller.

9. A printing machine including at least one doctor blade, screen roller, a printing roller with a sleeve and a counter-pressure roller, wherein the printing roller comprises a sleeve for a flexographic printing machine, including an axis of rotation and a longitudinal axis, where the printing roller is adapted for concentric mounting of the sleeve, and where the sleeve has a substantially cylindrical internal cylindrical surface for unbroken circumferential contact with the entire periphery of the printing roller, and wherein the sleeve has a continuous external surface, the external surface being substantially cylindrical and adapted for mounting a plate, where the substantially cylindrical external surface includes at least one longitudinal groove, where the at least one longitudinal groove includes a geometry with at least one surface, said at least one surface lying within a circumscribed cylindrical area of the external surface of the sleeve, wherein the longitudinal groove is adapted to fix a leading edge of the plate, wherein the geometry of the at least one longitudinal groove being of reduced diameter relative to and extending circumferentially continuously between the external surface of circular circumferential curvature, wherein the longitudinal groove or grooves have a depth between 0 and 3 mm, wherein the depth is the distance between the cylindrical surface of the sleeve and a bottom of the groove as measured on a cross-section at right angles to the rotary axis of the printing roller/sleeve, the longitudinal groove being of a depth in a radial direction that is less than a thickness of the plate, but sufficient to minimize jolting or bouncing of a leading edge upon contact with said counter-pressure roller.

* * * * *